United States Patent [19]

Hull et al.

[11] Patent Number: 5,040,689

[45] Date of Patent: Aug. 20, 1991

[54] ROTATING FILING CABINET

[76] Inventors: Harold L. Hull, 401 Canyon Wy. #43, Sparks, Nev. 89434; Karl H. Elze, 300 S. Carson Meadow Dr., Carson City, Nev. 89701

[21] Appl. No.: 527,280

[22] Filed: May 23, 1990

[51] Int. Cl.[5] ..... A47F 5/00

[52] U.S. Cl. ..... 211/121; 211/164

[58] Field of Search ..... 211/121, 164; 312/268, 312/134

[56] References Cited

U.S. PATENT DOCUMENTS

| | | | |
|---|---|---|---|
| 581,049 | 4/1897 | Ukenholz | 211/121 |
| 932,830 | 8/1909 | Thomas | 211/121 |
| 1,426,379 | 8/1922 | Hadaway | 211/121 X |
| 1,787,898 | 1/1931 | Fuller | 211/121 |
| 3,147,849 | 9/1964 | Scholfield et al. | 211/121 X |
| 3,909,090 | 9/1975 | Breckner et al. | 312/217 |
| 4,298,236 | 11/1981 | Laroche | 312/217 |
| 4,355,851 | 10/1982 | Slusser | 312/215 |
| 4,616,891 | 10/1986 | Jantzen | 312/328 |
| 4,676,560 | 6/1987 | Schmitz et al. | 211/121 X |
| 4,732,434 | 3/1988 | Hartman | 312/221 |
| 4,822,119 | 4/1989 | Compton | 312/328 |

*Primary Examiner*—Alvin C. Chin-Shue
*Assistant Examiner*—Sarah A. Lechok

[57] ABSTRACT

Rotating filing cabinets consisting of multiple drawers with the drawers being attached to a chain and sprocket arrangement which is power activated with the drawers being able to rotate in a substantially vertical loop enabling the operator to activate the power drive and bring any one of the multiple drawers to a predetermined level, such as eye level.

9 Claims, 3 Drawing Sheets

Fig 7
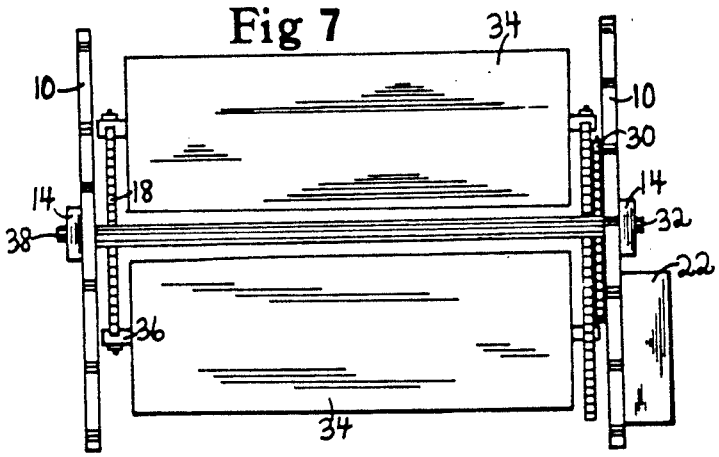
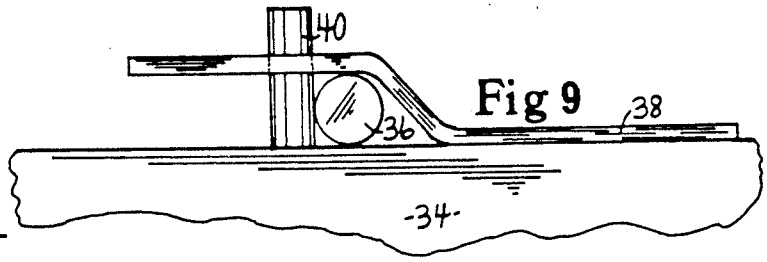
Fig 9
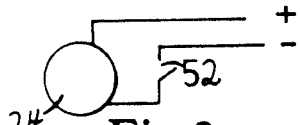
Fig 8
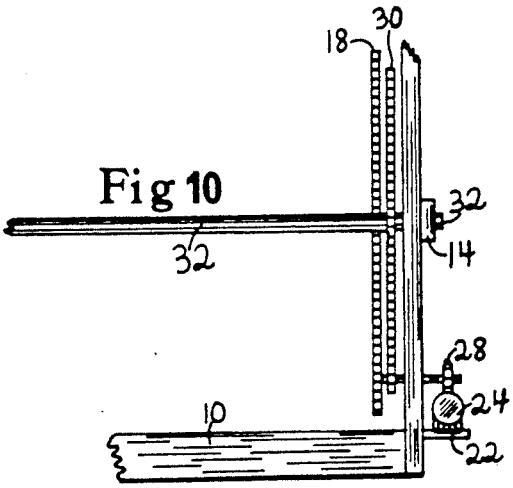
Fig 10
Fig 11
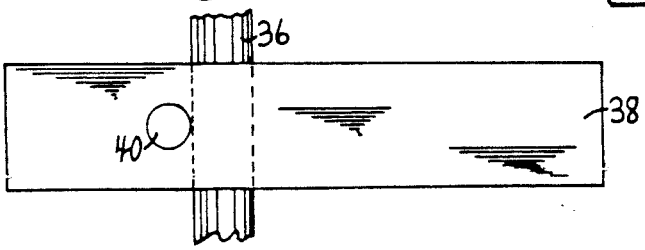

ROTATING FILING CABINET

This invention relates to rotating filing cabinets or drawers but more particularly to rotating file cabinets which when rotated will position the cabinet to a specific location, for example eye level.

BACKGROUND OF THE INVENTION

In the past, several rotating file cabinets have been taught such as U.S. Pat. Nos. 4,822,119 and 4,616,891 wherein they teach a rotating drawer or cabinet, however in both cases the cabinet only rotates at 360 degrees from a fixed central position. The present invention rotates the drawers or cabinets to a desired height. This appears to be most convenient for the user wherein they can position the cabinet to eye level, thus eliminating any unnecessary strain on the back and legs.

SUMMARY OF THE INVENTION

It is a primary object of the present invention to provide rotating filing cabinets, or drawers which may be adjusted to any desired height, for example eye level. This eliminates the need for stooping or bending, therefore being easy and convenient to use.

Another object of the present invention is to provide rotating file cabinets or drawers which are electrically powered, therefore, when a circuit is energized the cabinets rotate to the desired height. Therefore the user can select the cabinet of their choice.

Another object of the present invention is to save office space. Being that the drawers or cabinets are stacked one on top of the other, they may reach from the floor to the ceiling. Due to this design less floor space is needed.

Other objects and advantages will become apparent when taken in consideration with the following drawings and specifications.

BRIEF DESCRIPTION OF THE DRAWINGS

FIG. 7 is a bottom view.

FIG. 8 is a wiring schematic.

FIG. 9 is a side view of a support shaft mounting bracket and a drop pin.

FIG. 10 is a partial side view of the motor drive assembly.

FIG. 11 is a top view of a support shaft mounting bracket and a drop pin.

DETAILED DESCRIPTION OF THE DRAWINGS

Figure 1:
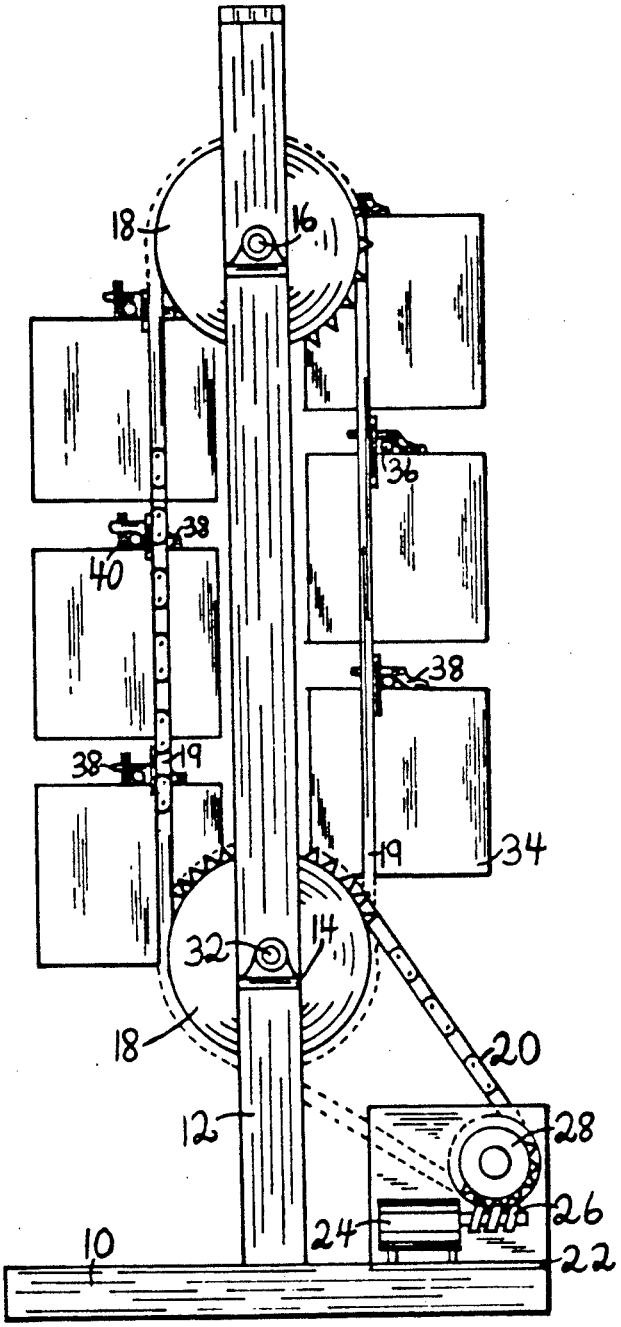
FIG. 1 is a side view.
Figure 2:
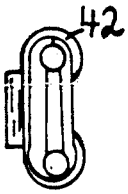
FIG. 2 is a side view of a spider link.
Figure 3:
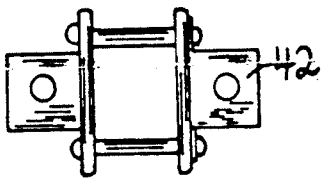
FIG. 3 is a frontal view of the spider link.
Figure 4:
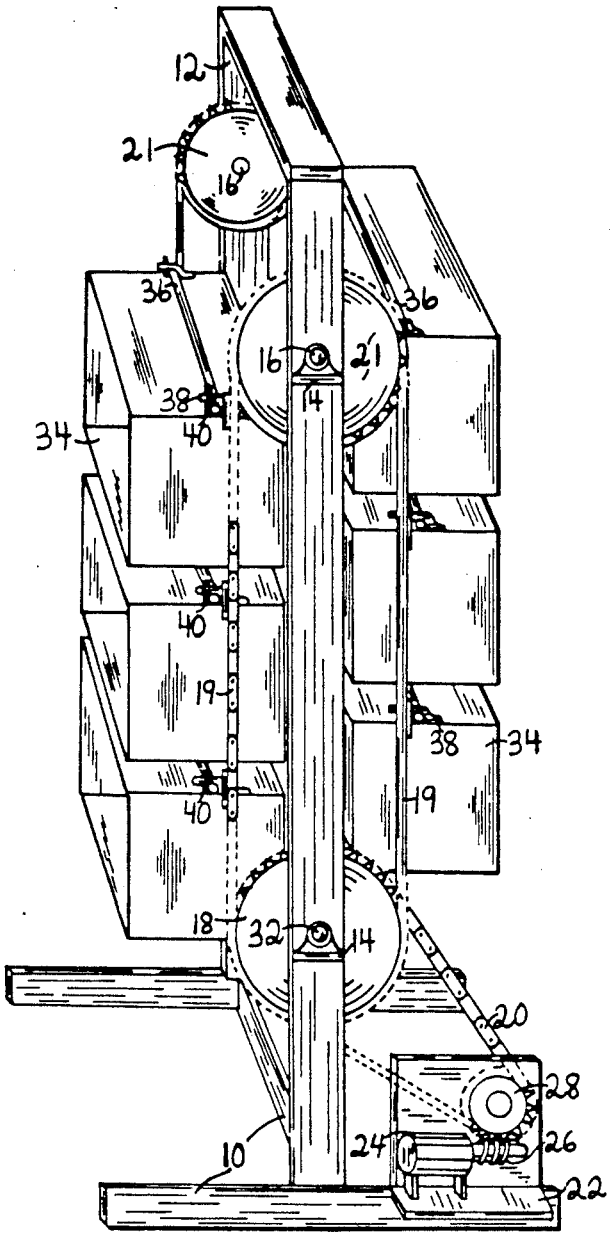
FIG. 4 is a perspective view.
Figure 5:
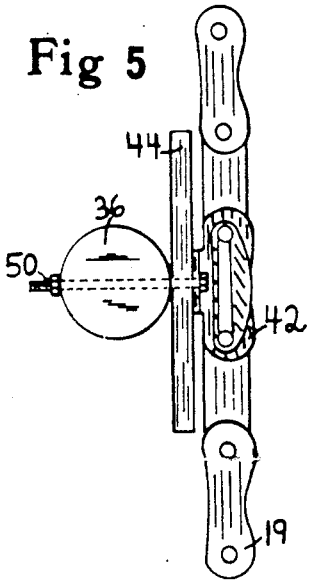
FIG. 5 is a side view of the spider link and the support shaft mounting means.
Figure 6:
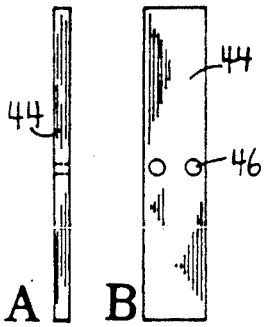
FIG. 6A is a side view of a chain stiffener.
FIG. 6B is a frontal view of a chain stiffener.

Referring now to the drawings wherein like numerals represent like parts throughout the various views, 10 is a base support structure which supports uprights 12 which in turn supports the four (4) bearings 14, the upper two, supporting short shafts 16, while the lower two, support the long drive shaft 32. The long drive shaft 32 is suitably affixed to the two lower sprockets 18 which drive chains 19 and upper sprockets 21, which in turn are attached by spider links 42, through chain stiffener 44, to shaft 32 by bolts and nuts 50. 46 are mounting holes in chain stiffener 44, matching mounting holes in spider link 42. 22 is a support affixed to base 10 for mounting motor 24 which drives a worm gear 26 which in turn drives sprocket 28 and sprocket 30 via sprocket chain 20. 34 are metal filing cabinets with mounting brackets 38 suitably affixed by means such as welding. 40 is a drop pin to keep shaft substantially locked into bracket 38 which allows cabinets 34 to swing freely from its top swivel point. 52 is a switch closing a circuit to energize motor 24.

It will now be seen that we have provided rotating file cabinets, or drawers which when triggered electrically by the user will enable the operator to position the drawer or cabinet to any desirable height.

We have also provided rotating drawers or cabinets which are easy and convenient for the operator.

We have further provided rotating drawers or cabinets which eliminate unecessary bending, back strain or stooping by the operator.

We have also shown rotating drawers or cabinets which, due to the design, will conserve office space.

We have further provided rotating drawers or cabinets which are easily removed or replaced.

Having described our invention, what we claim as new and desire to secure by letters patent is;

1. A rotating file cabinet comprising; a stationary base, said base having at least two horizontal parallel members, at least one cross member joining said parallel members together at substantially their centers forming substantially an I, at least two vertical parallel members joined at their lower ends to substantially the center portion of said horizontal members, at least one cross member joining said vertical members at their upper distal ends, said vertical members supporting at least two lower bearings and two upper bearings, said lower bearings supporting a common shaft between them, said common shaft supporting and being suitably joined to at least two lower sprockets, said common shaft supporting and being suitably joined to at least one drive sprocket, means to drive said drive sprocket, said two upper bearings supporting and being suitably joined to two upper independent shafts, respectively, said two independent shafts supporting and being suitably joined to two upper independent sprockets, respectively, drive chains between said lower sprockets and said upper sprockets, a plurality of drawers, each in the form of an elongated rectangular, parallelepiped, said drawers having a bottom wall, a top wall, a rear wall, two pair of opposed side walls, and a substantially open front, said drawers further forming a generally rectangular parallelepiped having a height, a width from side wall to side wall, and depth from front to rear, a shaft extending substantially across the center of said top wall, mounting brackets attached to said drawers at the distal ends of said top wall, a spider link, a stiffening member, said stiffening member being attached between said spider link and said shaft, means to attach said spider links to said shaft, at least two drop pins, said drop pins, said mounting bracket, said shaft, said stiffening member and said spider link cooperatin together to form a pivotable, detachable, connection of said drawers to said drive chain, whereby, said drawers can be easily removed or replaced, said plurality or drawers disposed in a generally vertical spaced array, whereby, when said means to drive said drive sprocket is activated, said drawers rotate in a substantially vertical loop, presenting each of their said substantially open fronts to an operator on demand.

2. The device of claim 1 in which said stationary base, said horizontal member, said cross members, and said vertical members, are made of metal and joined together by welding.

3. The device of claim 1 in which said means to drive said drive sprocket is by an electric motor and suitable mechanical linkage.

4. The device of claim 3 in which said mechanical linkage is a worm gear, a drive gear and a chain drive.

5. The device of claim 1 in which said means to attach said spider link to said shaft is by bolts and nuts.

6. The device of claim 1 in which said said mounting brackets are attached to said drawers by welding.

7. The device of claim 1 in which said stiffening member is a substantially rectangular metal plate, said metal plate having sufficient length and width to cover said spider link and at least two adjoining chain links.

8. The device of claim 1 in which said upper and lower bearings are ball bearings mounted in a pillow block.

9. The device of claim 1 in which said drawers are made of metal.

* * * * *